United States Patent [19]

Beconcini et al.

[11] Patent Number: 4,665,720

[45] Date of Patent: May 19, 1987

[54] PULLING WITH REVERSING DEVICE AND PROCESS FOR CIRCULAR KNITTING FRAMES

[75] Inventors: Paolo Beconcini, Florence; Giuseppe Caccivio, Scandicci; Dante Nannini, Incisa Val D'Arno, all of Italy

[73] Assignee: Officine Savio S.p.A., Pordenone, Italy

[21] Appl. No.: 748,623

[22] Filed: Jun. 25, 1985

[30] Foreign Application Priority Data

Jun. 29, 1984 [IT] Italy ..... 21654 A/84

[51] Int. Cl.[4] ..... D04B 15/88; D04B 15/92

[52] U.S. Cl. ..... 66/149 S; 66/149 R

[58] Field of Search ..... 66/149 R, 149 S, 153

[56] References Cited

U.S. PATENT DOCUMENTS

| | | | |
|---|---|---|---|
| 2,521,258 | 9/1950 | Semotán | 66/153 X |
| 3,292,394 | 12/1966 | Luchi | 66/149 R |
| 3,640,095 | 2/1972 | Lonati | 66/149 R X |
| 4,407,145 | 10/1983 | Lonati | 66/149 S X |

*Primary Examiner*—Wm. Carter Reynolds

*Attorney, Agent, or Firm*—Stevens, Davis, Miller & Mosher

[57] ABSTRACT

Device and process for pulling with reversing circular knitting frames, comprising a cylindrical shell coaxial with the needle cylinder or the needle cylinders of the frame, and positioned above the plane of formation of the knitted fabric. A cylindrical sleeve is positioned coaxially with the shell, and axially slidable within the shell. A rotatable expandable tensioning piston is positioned coaxially with the sleeve and axially movable within said sleeve to expand and clamp the knitted tubular fabric inside the sleeve and drag upwardly the sleeve as well as the tubular knitted fabric.

9 Claims, 3 Drawing Figures

PULLING WITH REVERSING DEVICE AND PROCESS FOR CIRCULAR KNITTING FRAMES

The object of the present invention is a device for pulling and reversing the knitted fabric formed in the circular knitting frames, as well as the relating process of pulling and reversing of the formed knitted fabric during its production.

The technical problems which the present invention is intended to solve consist in that the tubular knitted fabric which is produced inside the circular knitting frame must be kept under tension, to the purpose of obtaining a satisfactory discharge of the already formed fabric, and an absolutely regular formation of knitted fabric, and must be reversed, in order to allowing the subsequent operations to be carried out for obtaining the finished knitwear.

The invention is particularly directed to the use in the circular twin cylinder knitting frames for the production of socks, but it can be used as well also in the production of stockings. It can moreover be tailored to be used in circular knitting frames of other types.

For an easy understanding of the technical problems which appear during the stage of pulling and reversing of the tubular knitted item, the operating way of a circular frame must be taken into consideration.

The tubular knitted fabric is formed along the outside periphery of the cylinder which supports and guides the needles in their rotational and reciprocating motion in cooperation with the platens and the feeding devices of the thread; the tubular knitted fabric formed enters the cylinder itself, and here an axial tension is to be exerted on it, such as to create a centripetal tension on the stitches being formed. Such tension is an element of fundamental importance for the correct formation of the stitches.

It must be additionally remembered that the device for pulling and reversing the tubular knitted fabric must be positioned inside the cylinders of the circular frames. Such cylinders have generally an inner diameter which is not greater than 80–90 mm, and the frames of lesser sizes may have diameters as reduced as about 50 mm.

It must moreover be kept in mind that in the production of socks, the pulling action is generally required essentially during the formation of the tubular knitted fabric which forms the leg and the foot, during which stage, indeed, both cylinders operate along their whole circumference.

When the heel and the toe are formed, the knitting is carried out by plain stitches, on one cylinder only, and along a portion of the circumference. In this stage, a pulling action is not generally required for the correct discharge of the knitted fabric formed.

The presently known devices for the pulling and reversing of the tubular knitted fabrics are essentially of two types.

A first type, which is the object e.g. of U.S. Pat. No. 4,407,145 and Italian Pat. Appln. No. 23 547A/78 filed on May 18, 1978 provides the clamping of the first part of the tubular fabric, the so-called cuff of the sock, by means of a clamping head, e.g. of cone frustum shape, against a coaxial axially fixed tubular element, and the tensioning and the reversing of the tubular knitted item which is subsequently formed by means of another hollow tubular movable element, coaxial with and external to the previous one, which is made go down as the tubular fabric is formed, keeping it under tension, and reversing it.

Such device, which is positioned inside the upper cylinder, when going downwards, forces the tubular item to go along a double bend path.

When the item is finished, its cuff is clamped by the clamping head, its intermediate portion is in contact with the movable tubular element in the position of maximum extension, and its end portion is restrained by the needles; the finished knitted tubular item is therefore only half-way reversed, and forms a toroid with U-shaped section.

To the purpose of completing the reversing of the tubular knitted fabric, the clamping head is disengaged from the fixed tubular element, and the movable tubular element is made go upwards, the already partly reversed tubular fabric is drawn by suction. The same suction is used to the purpose of discharging the tubular fabric, after it having been disengaged from the needles.

This type of device shows the advantage that the stroke of the actuator is halved, its axial overall dimensions being therefore limited, but it suffers from other drawbacks.

Such devices indeed are characterized by many points of wear and possible damaging of the tubular item, between the fixed tubular element and the clamping head, at the end of the sliding tubular element which slips on the knitted fabric and forces it to the double bend, and finally at the end of the lower cylinder. These friction points, and in particular the slipping of the movable tubular element, should a heavily worked (not plain) fabric be produced, involve the possibility of the item to be damaged. Such devices are complex and delicate as for setting up and maintenance.

In such devices indeed the clamping head and the fixed tubular element must rotate freely and coherently with the cylinders, but the atmospheric frictions and the friction between the tubular knitted fabric and the hollow tubular movable element make the effective elimination of the residual torsion very uncertain, unless very complex devices are adopted of interlocking of the cylinders and the reversing device to each other.

Another type of device, which is the object e.g. of the German pulished Pat. Appln. No. P2946145.8, provides the removal of the tubular knitted fabric during its formation by means of the actuation of a plurality of tubular elements, coaxial with the upper cylinder, and capable of short reciprocating axial shifts, which cooperate with a lower conical element, which is flared upwards, and is positioned on the upper end of the lower cylinder, within which the tubular knitted fabric enters, as it is formed.

Such upper coaxial tubular element, during their reciprocating motion, engage alternately the conical element, clamping the tubular knitted fabric, and pulling it downwards, thus discharging it from its formation area.

Inside the tubular elements a vacuum suction is exerted, which reverses the item and keeps it in the vertical position, directed upwards. This type of device allows the tubular knitted fabric to be completely reversed, during its manufacturing.

The clamping elements, the so-called cups, for clamping the tubular fabric, are made, in the presently most diffused embodiments, from elastomeric materials, with characteristics of adherence and of elastic modulus, such to allow the tubular knitted fabric to be clamped with reduced pressures, and with a good absorption of the impact.

The alternate clamping and release actions of the tubular knitted fabric allow the tension to be applied, which is needed for the correct formation of the fabric. The high production rate required for the knitting frames, however, and the steadiness of the discharge action required for a regular formation of the tubular knitted fabric, cause the clamping and release actions to have frequencies of hundreds of cycles per minute, of about 300 cycles per minute in the more recent machines.

Such high frequencies, notwithstanding the elastomeric materials adopted, create problems of dynamic character—such as vibrations, together with all the drawbacks connected therewith—and problems of heavy wear of the clamping elements, which require frequent interventions of substitution and setup; another drawback is the fact that the tubular knitted fabric is clamped by the clamping element after that it has retracted and has entered inside the cone frustum shaped area, and that the clamping action on the tubular fabric creates in it creases and wrinkles, which reduce its value.

These devices too, finally, are characterized by the double folding of the tubular fabric, and by the slipping of it against the elements of the machinery.

Purpose of the present invention is a device and a process of pulling and reversing of the tubular knitted fabric, without said item being submitted to double foldings, or to excessive slippings against parts of the machine. A further purpose of the present invention is a pulling device, which carries out the tensioning of the item in a smooth and progressive way, allowing a tubular knitted fabric to be produced of uniform characteristics, and without faults.

The present invention will be described in more detail with respect to the embodiments shown in the accompanying drawings given by way of non-limitative example, in which equal or equivalent parts are marked by the same reference numerals and in which.

Figure 1:
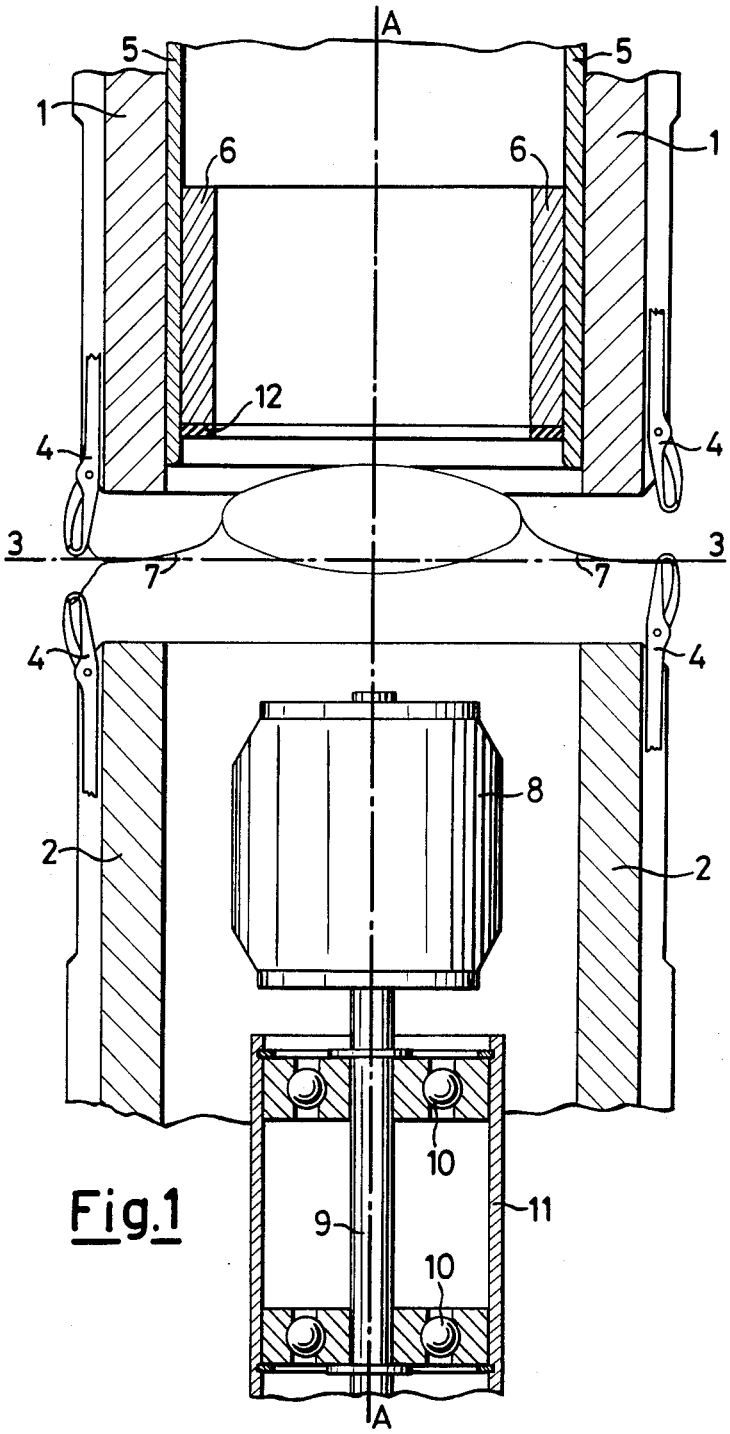
FIG. 1 is a schematic elevational view of a circular twin cylindrical knitting frame illustrating the starting position of the present invention.

According to the schematic illustration of FIG. 1, the device and the process of pulling and reversing of the tubular knitted fabric according to the present invention is disclosed here with reference to a circular knitting twin cylinder frame 20 (FIG. 3), such process and device being however advantageously utilizable in any types of circular knitting frames.

The upper and lower cylinders are schematically shown with 1 and 2; the tubular knitted fabric is indicatively formed on the plane 3 of the needles 4, positioned on the outside surface of 1 and 2, within suitable sliding grooves. Inside 1, and angularly solid with it, a cylindrical shell 5 is placed.

Inside 5, and coaxially with it, a sleeve 6 is placed, only capable of axial movements relatively to 5. It is shown in its lowest position of end of stroke.

The axial motion of the sleeve 6 relatively to the shell 5 can take place along vertical guides, not shown.

During the manufacturing of the knitted fabric, all parts hereinabove described rotate around the axis AA.

At the beginning of the production of the tubular knitted fabric, the tubular fabric produced and shown as 7 is submitted to suction apparatus 16 (FIG. 3) from the above, and tends to position itself in that direction. As soon as the tubular knitted fabric has reached a sufficient length, of the magnitude of 15–30 mm, the tensioning piston 8 is actuated.

Said tensioning piston comprises essentially an expandable means in its outside cylindrical or sub-cylindrical face, is provided with axial movement according to AA, and can freely rotate around the axis AA, which preferably is its symmetry axis.

The tensioning piston 8 is raised from its resting position inside the lower cylinder, as it is shown in FIG. 1, and engages the already formed tubular knitted fabric, and raises it until it contacts the inner surface of sleeve 6.

The piston 8 is actuated for vertical motion by the rod 9, which can rotate, and is in turn supported by bearings, 10, supported by the hollow stem 11, which in turn does not rotate, and transmits the push to the rod 9 and to the piston 8.

Figure 2:
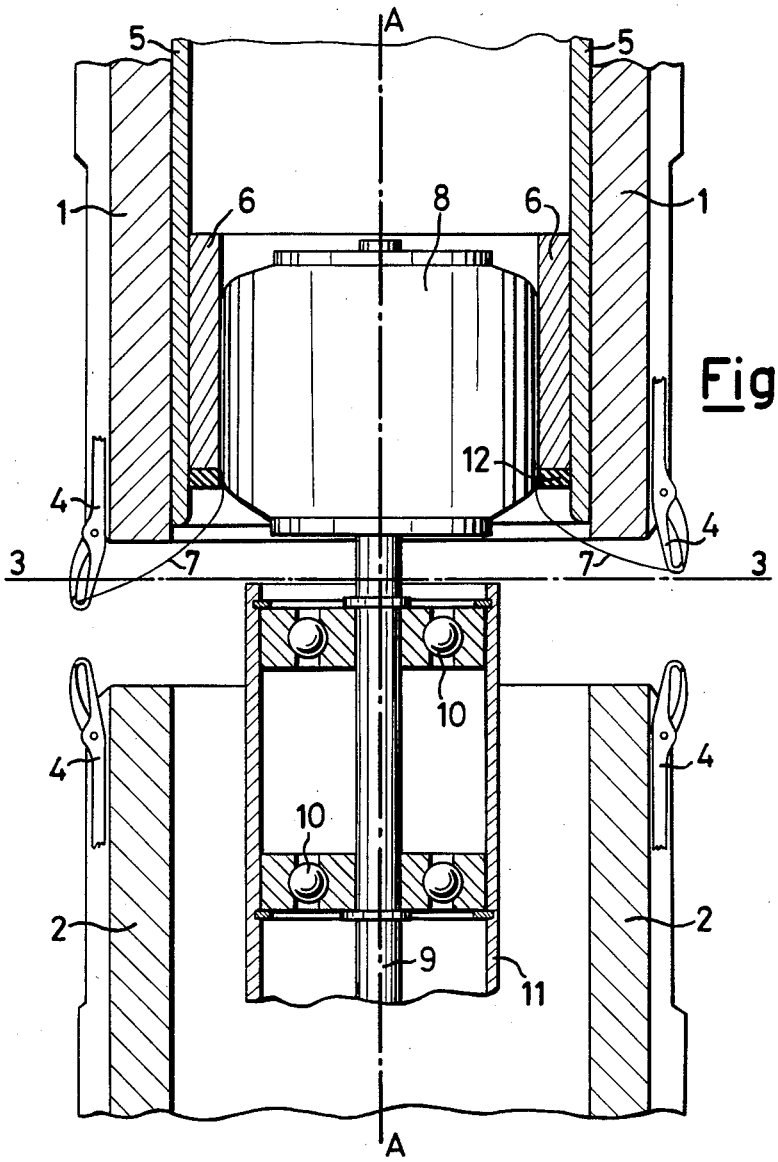
FIG. 2 is a schematic elevation view of the frame of FIG. 1 in a position clamping the tubular knitted fabric.

The device has now assumed the configuration shown in FIG. 2.

The expandable means of the peripheral surface of 8 is then actuated, bringing the periphery of 8 in engagement with the sleeve 6, between them the tubular knitted fabric 7 is clamped.

According to a preferred, but not limitative, embodiment, the expandable means is formed by an elastic membrane.

The expansion of said membrane is carried out by the feeding in it of a pressurized fluid, such as a pressurized hydraulic fluid, compressed air, or similar fluids.

After the contact has taken place, the piston 8 rotates solidly with the tubular knitted fabric 7, and the sleeve 6.

The suction action is no longer necessary, and it is preferably discontinued.

The action of pulling and reversing of the tubular knitted fabric is now carried out by the movement of the piston 8, which continues its run upwards, thus applying the desired tension.

The piston 8, solid with the tubular knitted fabric 7 and the sliding sleeve 6, is moved, together with them, upwards, as the production goes onward of the tubular knitted fabric. Any friction and damagings of the fabric are thus avoided.

The vertical displacement of 8 and the tension conferred to the item 7 can be controlled by means of a control of hydraulic type, or of compressed air type, or of magnetic type, or similar controls.

When the tubular knitted fabric has been finished, the sleeve 6 and the piston 8 are in their upper end of stroke position, which can obviously be adjusted as a function of the item which is intended to be produced.

At this time, the upwards suction action is restarted, the expansion means situated on the peripheral surface of 8 is disengaged, and the piston 8 is moved downwards.

The finished tubular knitted fabric 7 is kept in upwards vertical position by the suction.

When the end part of 7 is released from the needles 4 the same suction allows the tubular knitted fabric to be discharged upwards. The sleeve 6 returns towards its lower resting position owing to its weight; to the purpose of limiting the impacts, it has been simply shown an elastic gasket 12, solid with 6, which, upon the return of the sleeve to its resting position, engages a shoulder solid with 5, not shown for simplicity purposes. Such solution may be replaced by other return devices of greater complexity, which make it possible a more accurate control.

As it can be observed, the device according to the present invention has a very reduced number of movable elements, a very simple structure, and does not require particularly careful setup processes.

The slipping of the tubular knitted fabric against the parts of the machine is prevented for the most part, and phenomena are not observed of wearing and wrinkling of the item.

The device and method of pulling and reversing according to the invention can be used also for the production of stockings or similar tubular products on considerable length.

This can be carried out both by providing the sleeve 5 and the actuator 11 with a long enough stroke, and by repeating twice or more times the cycles, with the obvious warning that during the return of the sleeve 6 and of the piston 8 to the initial positions, the suction upwards be kept operating, in order to maintaining vertically positioned the already produced part of the tubular knitted fabric.

The pulling and reversing process whose essential outline has been described hereinbefore, requires that the piston 8 provided with expansion means be, at the beginning of the operating procedure, in its lower resting position shown in FIG. 1, and without rotational motion.

It is clear that, when the piston is moved upwards along the initial portion of its stroke, and engages the cuff of the tubular knitted fabric 7, and immediately later on, the sleeve 6, said piston 8 acquires the same rotary motion as 6 and 7.

However, during the very short time during which the piston 8, which is not yet rotating, contacts the tubular knitted fabric 7, and is not yet engaging 6, a slight torsional stress is applied to the initial part of the tubular knitted fabric 7, the so-called cuff.

Especially in the manufacturing of socks, such stress, during the very short time period between the contact with 7 and the engagement with 6, does not cause any troubles in the frames for normal production, in which the turning speed is of the order of 200–400 revolutions per minute.

Should the device according to the invention be used for more delicate tubular knitted fabrics, or with greater turning speeds, starting rotating the piston 8 may be foreseen, before the piston comes in contact with the tubular knitted fabric 7.

The necessary rotary motion can be derived from other rotary parts of the machinery.

Figure 3:
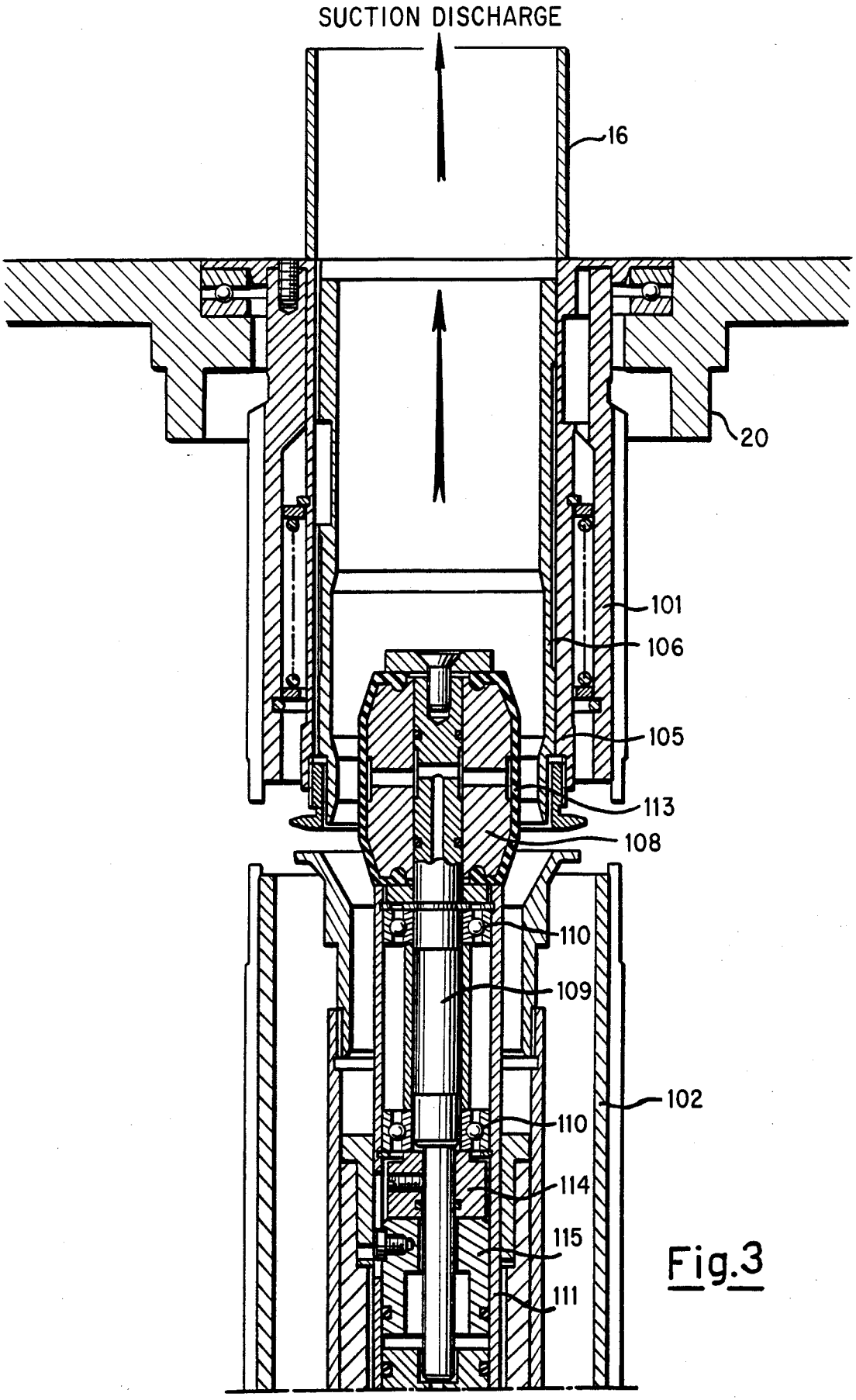
FIG. 3 is a sectional view of an embodiment of the present invention for the production of socks.

To the purpose of evidencing the advantages and the simplicity of the process and device according to the invention, an embodiment is disclosed, with reference to FIG. 3, for exemplifying and not limitative purposes, of the device applied to a twin cylinder frame for the production of socks.

101 and 102 are respectively indicative of the upper and lower cylinders, 105 indicates the shell solid with 101, or more precisely the tubular guide for the sliding sleeve 106. 108 Indicates the body of the piston, or more precisely the piston adapter, which will be discussed in greater detail hereinafter. The feeding shaft for the pressurized fluid is indicated with 109, and the bearings with 110. The membrane which is expanded under the action of the pressurized fluid is indicated with 113. The seals of the pressurized fluid, respectively the rotary and the fixed seal, are indicated with 114 and 115. For the sake of clearness, the rotary parts are shown in oblique full lines section lining, the fixed parts are shown in section lining, and the parts are shown in oblique dotted lines section lining, which rotate during the engagement with the tubular item only. It can be observed that a noticeable advantage of the device according to the invention is the limitedness of the space occupied by it inside the upper cylinder, and the fact that the tubular knitted fabric is consequently pulled upwards without any significant reduction in its diameter. The efficaciousness and the regularity of the suction and discharging actions are guaranteed by such reduced overall dimensions.

The structure of the device may be standardized also for frames of different diameters, such standardization being not easy for the devices according to the presently known art.

It is enough indeed, as far as the piston area is concerned, to replace the piston adapter 8, to be able to operate on even very different machine diameters.

For not very different machine diameters, such replacing is not even necessary, in that the expandable means itself can provide for the variation.

It should also be noted that the clamping action of the tubular knitted fabric by the membrane 113 against the sleeve 6 is very soft, and can be adjusted as desired by means of the pressure of the expansion fluid.

We claim:

1. Pulling with reversing device for pulling and reversing the tubular knitted fabric manufactured by the circular knitting frames, comprising:

a frame, a cylinder on the frame;

a cylindrical shell coaxial with the cylinder of the frame, rotating solidly with it, and positioned above the plane where knitted fabric is formed;

a cylindrical sleeve rotating and coaxial with said shell, and axially sliding inside it;

a tensioning piston capable of axial motion inside said sleeve and coaxial with it, said piston being provided on its cylindrical or sub-cylindrical outside face with an expandable means, which, while being in the expanded state, engages the cylindrical sleeve rotating and sliding solidly with it inside the shell; and a suction element, which pulls the tubular knitted fabric, while it is formed, in a vertical position, directed upwards.

2. The device as claimed in claim 1, characterized in that the tensioning piston is idly rotatable, with its rotation axis being coincident with that of the cylinders.

3. The device as claimed in claim 1, characterized in that in twin cylinder frames the coaxial cylindrical shell is positioned inside the upper cylinder, and rotates solidly with it.

4. The device as claimed in claim 1, characterized in that the useful stroke of the tensioning piston along the axis of the frame starts from a lower resting position beneath the plane where the knitted fabric is formed.

5. The device as claimed in claim 1, characterized in that the expandable means placed on the outer face of the tensioning piston consists of an elastic membrane actuated by means of a fluid under pressure.

6. The device as claimed in claim 1, characterized in that the tensioning piston is actuated in its axial stroke by a hollow stem actuator, not rotatable, which supports through bearings the piston itself, which is in turn freely rotatable relatively to the actuator.

7. A process for pulling and reversing tubular knitted fabric comprising:

starting the production of the tubular knitted fabric with needles, while an expandable tensioning piston is kept in a lower resting position; carrying out from above a suction action, which pulls said tubular knitted fabric upwardly in a vertical position, a sufficient length for being clamped; actuating the piston upwardly to raise it from its lower resting position, to a level of the tubular knitted fabric which has already been produced;

expanding the piston to force contact of the piston with the tubular knitted fabric, and a rotary moving vertically slidable sleeve external to said fabric, which drags into rotary motion the expanded tensioning piston;

continuing the upwardly movement of the piston while continuing the pulling and reversing action thereon until the piston reaches the end of its useful stroke; contracting the expanded cylinder, thereby releasing from clamping the cylindrical sleeve, as well as the tubular knitted item; and lowering the tensioning piston and the sleeve to positions of rest while reasserting suction of the tubular knitted item until removed from the needles and discharged upwards.

8. The process as claimed in claim 7, including clamping and tensioning the tubular knitted fabric a number of times.

9. The process as claimed in claim 7, including discontinuing the action of suction upwards when the tensioning piston is in a clamping position with the cylinderical sleeve and is axially moved together with it, and restarting the action of suction upwards for the other operational stages.

* * * * *